US008067693B2

(12) United States Patent
Sun et al.

(10) Patent No.: US 8,067,693 B2
(45) Date of Patent: Nov. 29, 2011

(54) BUS FOR HIGH DEFINITION MULTIMEDIA INTERFACE

(75) Inventors: Din-Kow Sun, Walnut, CA (US); Chung-Ho Hsieh, Taipei (TW)

(73) Assignee: Lishen Machinery Co., Ltd., Taipei (TW)

( * ) Notice: Subject to any disclaimer, the term of this patent is extended or adjusted under 35 U.S.C. 154(b) by 0 days.

(21) Appl. No.: 11/535,490

(22) Filed: Nov. 17, 2006

(65) Prior Publication Data

US 2008/0115966 A1 May 22, 2008

(51) Int. Cl.
*H01B 7/08* (2006.01)

(52) U.S. Cl. ..... 174/117 F

(58) Field of Classification Search ..... 174/117 F, 174/113 R

See application file for complete search history.

(56) References Cited

U.S. PATENT DOCUMENTS 4,185,162 A * 1/1980 Bogese, II ..... 174/32
4,381,426 A * 4/1983 Cronkite et al. ..... 174/117 F
6,248,954 B1 * 6/2001 Clark et al. ..... 174/113 R

* cited by examiner

*Primary Examiner* — Chau Nguyen

(57) ABSTRACT

A bus for the high definition multimedia interface (HDMI) is disclosed. The bus comprises a plurality of transmission lines and two clad layers. The conductive lines comprise a plurality of mutually twisted conductor lines arranged in a flat shape. The clad layers are disposed on two opposite surfaces of the twisted conductor lines sandwiching the transmission lines in-between. Since the transmission line sets are arranged in a juxtaposed structure, the bus can be easily bent for routing and coupling to reduce the installation space, streamline the manufacturing process, and reduce the overall manufacturing cost. Furthermore, a continuous extended shield can be used to penetrate or surround a cord set comprised of a group of transmission. Furthermore, the transmission lines may be covered to shield the cord set to protect the signal from external electromagnetic wave interference between the cord sets during the high frequency transmission.

4 Claims, 4 Drawing Sheets

BUS FOR HIGH DEFINITION MULTIMEDIA INTERFACE

BACKGROUND OF THE INVENTION

1. Field of the Invention

The present invention relates to a type of bus, and more particularly to a bus for the High Definition Multimedia Interface (HDMI) that can be manufactured by a simple process, and capable of reducing the distortion caused by the kink effect and the magnetic field interference.

2. Description of Related Art

Traditionally, Cathode Ray Tube (CRT) displays take analogous signals; hence the connectors are designed for transmission of analogous signals, in which a Digital to Analog Converter (DAC) is used to convert digital signals from a display card in a computer into analogous signals, and then the analogous signals are transmitted to a digital display where the analog signals are converted again into digital signals using an Analog to Digital Converter (ADC) circuit. Since signals are first converted from digital to analogous, and then transmitted in analogous form and converted back into digital signals for display, disturbance of signals may occur and cause fidelity losses. If it is possible to directly transfer digital signals to a digital display without any conversions of signals, the problems of signal fidelity losses due to disturbances described above may be effectively prevented. Therefore, digital interface for pure digital signal transmission provides better transmission quality than traditional analogous signal transmission.

To achieve better signal transmission quality, the Digital Visual Interface (DVI) has been developed, which aims principally to connect to computer display cards to provide digital display output functions, for example, displaying RGB signals from computers. Therefore, during the transfer process of the DVI digital interface, the transmission of digital format is entirely unchanged in order to ensure the data integrity along the transmission path from the host computer to the monitor without the disturbance of signals. Thus, better image quality can be displayed on digital displays such as liquid crystal (LCD) projectors, and plasma TV, LCD TV. Product specifications of certain high end products specifically illustrate the features of DVI plug.

Although DVI does provide a better signal transmission quality, it is only used for digital video signal transmission, and is not available for audio portions. For this reason, many manufacturers have redesigned the HDMI bus/port based on the DVI bus/port, wherein such interface encompasses not just video signals but audio parts as well. By loading audio and video signals onto the same cable line, the need for multiple signal line connections is eliminated, enabling safe transmission of uncompressed or compressed high definition video and multi-channel audio signals. Thus, massive high definition and high quality digital contents may be provided to facilitate the reduction of number of connections and usage simplification; therefore, HDMI has become one of the many critical technologies for consumer electronic devices of the new generation. As a result, DVI has become a standard interface for future flat display apparatus.

FIG. 4 illustrates a 3D diagram of a signal transmission line 30 for the HDMI, wherein comprises plural sets of paired conductor lines 311 and 312 bundled in juxtaposition. Conductor lines 311 and 312 respectively comprise copper conductors 311*a* and 312*a* which are respectively wrapped with insulation layers 311*b* and 312*b*. A layer of aluminum foil 32 is adopted to circumferentially surround the paired conductor lines 311 and 312. A layer of copper braid 33 and a layer of insulation 34 are used to circumferentially surround the layer of aluminum foil 32. In this way, the transmission line 30 is formed and used for signal transmission.

In the transmission line 30, metallic layers such as the aluminum foil layer 32 and the copper braid layer 33 may be used to protect the signal transmission from external disturbance. In addition, paired conductor lines 311 and 312 are twisted together in order to avoid mutual signal interference.

The conventional transmission line 30 is usually in a cylindrical shape with a wider internal diameter. Because the electronic devices, such as LCD projectors, Plasma TV's, LCD TV's or personal computers, are usually installed close to walls, and because the conventional transmission line 30 can not be excessively bent, this makes it impossible to position electronic devices in close proximity of walls and causes inconvenience during installation work.

Meanwhile, when conductor lines are coupled to a connector, each conductor line must be first located to the corresponding position of fixed wire material in the connector in such a way that the transmission lines and the connector can be mutually joined. Thus, assembly operations can be very time-consuming and expensive.

Furthermore, if the coupling direction between the connector at the end of the transmission line 30 and the connector plug on the body of the electronic device mismatch, the transmission line 30 must be turned awry. Due to the significant diameter of the transmission line 30, the interior conductor lines 311 and 312 may be easily broken or damaged, leading to problems of signal transmission failure or bad contact within the transmission line 30.

Because of the significant internal diameter, it might not be easy to bend the transmission line 30 when being plugged into the body of electronic device, and may easily get damaged if excessively bent. Hence, it is important not to overly twist or bend the transmission line 30 with excessive force when connecting to the body of the electronic device.

Since the transmission line 30 is circumferentially wrapped with the layer of aluminum foil 32 and the layer of copper braid 33, the weight of the HDMI transmission line 30 is substantially increased. Thus, the lengthy transmission line 30 must be supported with fixture members in order to avoid possible damage due to the pulling force at the two ends of the transmission line 30.

The structure of the transmission line 30 is much more complicated; in that, the external surface of the conductor lines 311 and 312 are circumferentially wrapped with a layer of aluminum foil 32, a layer of copper braid 33, and an insulation layer 34. Thus, the manufacture of the transmission line 30 requires at least 3 material wrapping processes. Hence, the complexity of manufacturing process would significantly increase the cost.

As mentioned above, the HDMI is one of the major technologies of future multimedia electronic devices, but the structure of the transmission line 30 indeed presents the aforementioned drawbacks. Therefore, resolving the drawbacks described above is an important issue for the manufacturers in the field.

SUMMARY OF THE INVENTION

In view of the above-mentioned drawbacks in prior art, the major objective of the present invention is to provide a bus for the HDMI.

Another objective of the present invention is to provide a bendable bus for the HDMI to reduce the installation space.

Yet another objective of the present invention is to provide a cost-effective bus for the HDMI, which is capable of reducing the cost.

Yet still another objective of the present invention is to provide a machinable bus for the HDMI, which offers convenience for machine tooling.

To achieve the aforementioned objectives, the bus for the high-definition multimedia interface of the present invention comprises: plural sets of transmission lines comprising twisted pairs of conductor lines, juxtaposed in a flat shape, and two clad layers, formed on the upper and lower surfaces of the juxtaposed transmission lines, sandwiching the transmission lines between the two clay layers. Furthermore, a continuous extended shield can be used to penetrate or surround a cord set comprised of a group of transmission. Furthermore, the transmission lines may be covered to shield the cord set to protect the signal from external electromagnetic wave interference between the cord sets during the high frequency transmission.

In a preferred embodiment, the bus further comprises at least 3 sets of channel lines, a clock line set, a display data line set and a plurality of control lines, wherein the channel line sets are used for transmitting video and audio signals. The channel line sets are composed of two twisted conductor lines and a ground line. The twisted conductor lines and the ground line may be adopted to prevent external disturbance and internal interference of signals. Thus, the use of materials, for example, aluminum foil layer and copper braid layer, as in the case of the prior art may be avoided. Therefore, the cost may be reduced.

Since the heavy materials such as aluminum foil layer and copper braid layer are not utilized for surrounding the conductive lines, the weight of the bus may be significantly reduced. As a result, the use of fixture members for supporting the transmission lines for reasons described above with reference to the prior art may be avoided.

Because the transmission lines are arranged in pairs, juxtaposed and sandwiched between the upper and lower clad layers, it is possible to eliminate the complex tube-like wrapping of the conductive lines, thus simplifying the manufacture process and reducing the manufacturing cost.

Besides, plural sets of transmission line of the present invention are juxtaposed such that the cross section becomes a flat structure and can be easily bent for coupling with the connectors on the bodies of the electronic devices, thereby avoiding possible damages caused by forceful bending. Thus, better convenience is provided to users.

Also the present invention has plural sets of transmission line juxtaposed so as to provide a structure of flat shape, which can be easily bent for inserting into the gap between the body of the electronic device and the wall, thus reducing the space occupation thereof and allowing the bodies of the electronic devices to be located at the desired position in a well-organized manner.

DETAILED DESCRIPTION OF THE INVENTION

The following illustrations describe the implementations of the present invention by means of specific embodiments, and those skilled in the art can rapidly appreciate other advantages and features of the present invention through the disclosed contents in the specification. The present invention can also be implemented or applied by other different embodiments, wherein various details in the specification can be modified and changed based on the different viewpoints and applications without departing from the spirit of the present invention.

Figure 1:
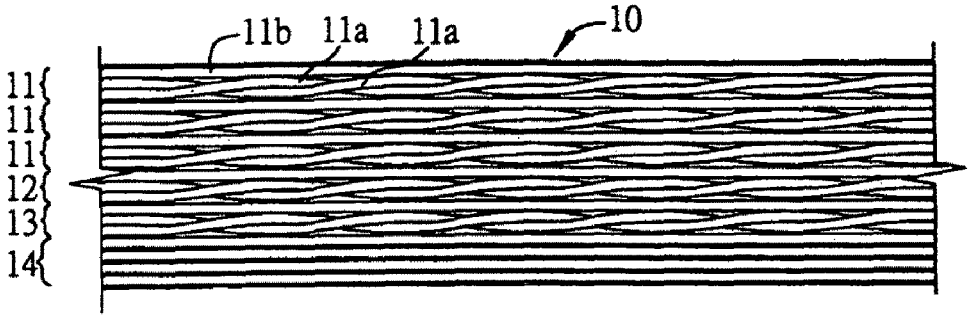
FIG. 1 shows a front view of a bus for the HDMI according to an embodiment of the present invention.
Figure 2:
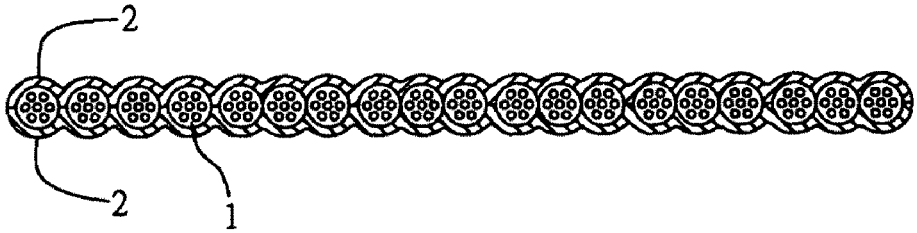
FIG. 2 shows a cross-sectional view of the bus for the HDMI according to an embodiment of the present invention.

Referring now to FIG. 1 and FIG. 2, wherein the front view and cross-sectional view of a bus for the HDMI are respectively shown, the bus 10 for the HDMI provided by the present invention comprises plural sets of transmission line 1 and a plurality of clad layers 2. The transmission line set 1 is juxtaposed in a flat shape, and the clad layer 2 is disposed on the upper and lower surfaces of the transmission line set 1. The bus 10 of the present invention may be manually or automatically manufactured and preferably manufactured by employing the method disclosed in the patent application serial number 921153352 filed on Jun. 6, 2003 in Taiwan, Republic of China.

Figure 3:
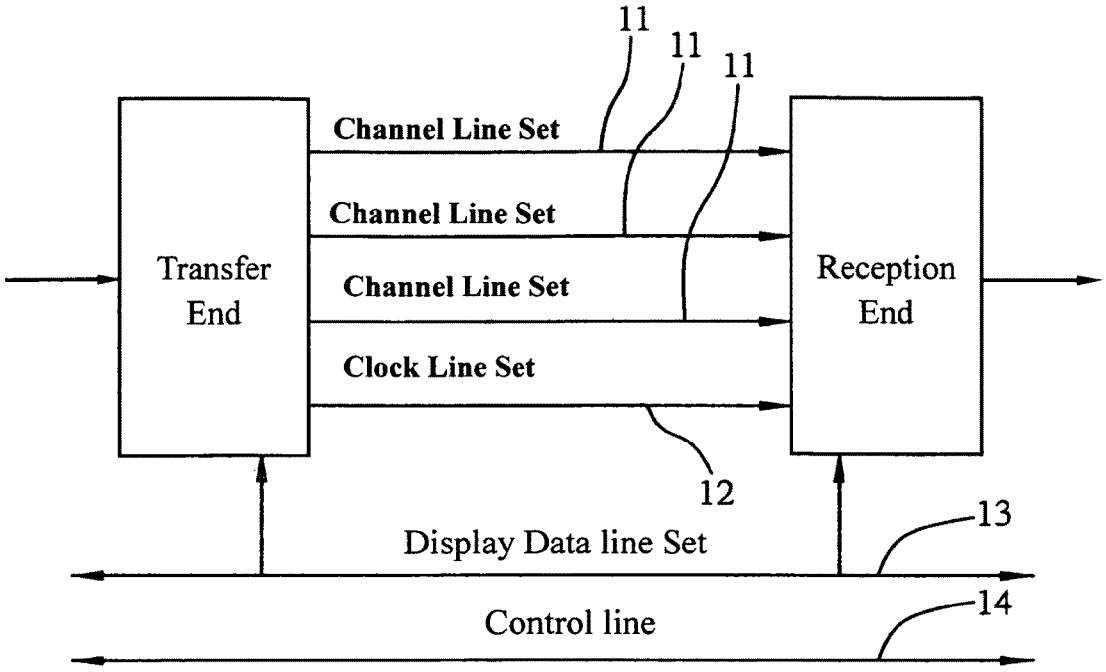
FIG. 3 shows a functional diagram of the bus for the HDMI according to an embodiment of the present invention.
Figure 4:
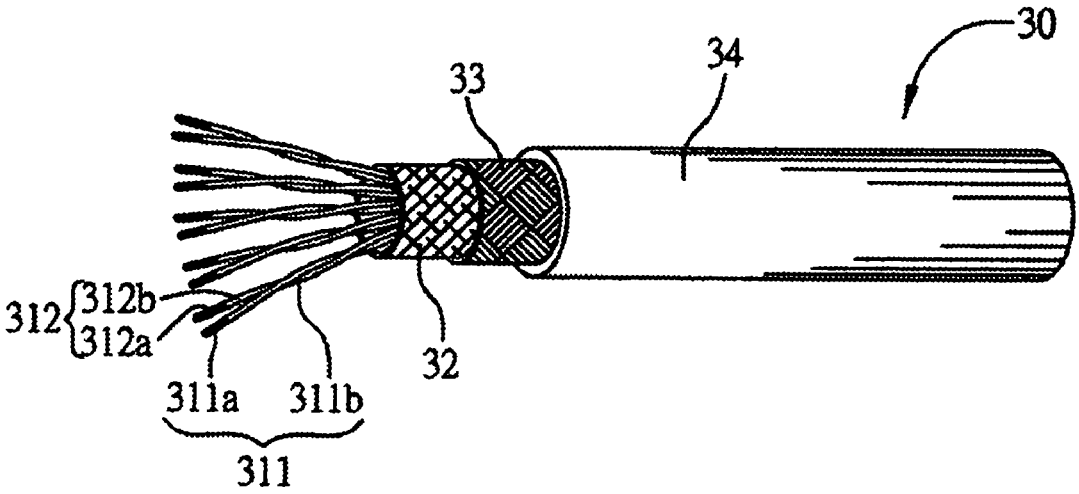
FIG. 4 (Prior Art)
FIG. 4 shows a 3D diagram of prior art transmission lines.

Referring to FIG. 3, which illustrates a functional diagram of the transmission line set 1 of the bus 10, the transmission line set 1 comprises at least 3 sets of channel lines 11, a clock channel line set 12, a display data channel line set 13 and a plurality of control lines 14. Each channel line set 11 comprises two mutually twisted conductor lines 11*a* and a ground line 11*b*. The channel line sets 11 are used for transmitting video signals and audio signals. The clock channel line set 12 is used for transmitting clock signals in response to data transmission by the channel line sets 11. The display data channel line set 13 is used for displaying the data of transmitted signals, such as data name, size, time, etc. The control line 14 may be used for controlling signals according to users' requirements and providing more flexibility to users.

The two conductor lines 11*a* of the channel line set 11 are mutually twisted together with a ground line 11*b* such that the conductor lines 11*a* facilitate mutual cancellation of the internal interference between the conductor lines. In addition, the external disturbance of the signals can also be avoided by means of the ground line 11*b*. Thus, neither the external disturbance nor the internal interference would adversely influence the transmission line set 1 during signal transmission, and the signal transmission quality may be effectively promoted.

Accordingly, the channel line sets 11 can prevent disturbance and interference, and hence the need of aluminum foil or metal braid layers as in the case of the prior art can be avoided. Thus, the material cost may be effectively reduced. Because the bus 10 does not employ the aforementioned metallic layers to serve as a shielding structure, the weight of the bus 10 may be substantially reduced so that the use of fixture members for supporting the weight of the lengthy transmission line set 1 may be avoided, thereby providing more convenience.

Furthermore, the structure of the bus 10 is simple, in which the plural sets of transmission line 1 are juxtaposed in flat shape and the clad layers 2 are disposed on the upper and lower surfaces of the transmission line set 1 forming a sandwich structure. Thus, it is possible to reduce the costs and increase market competitiveness. Compared to the prior art, buses of the present invention can be more conveniently joined with the connectors, and provide the aforementioned advantages.

Additionally, the cross section of the bus 10 presents a flat contour, and it can be easily bent for proper routing without being damaged to reliably connect the connectors. Also, the external flat appearance of the bus 10 may have a smaller bending radius, and can be bent to a narrower radius, allowing the bus 10 to be inserted in a small gap. Thus, space occupation may be reduced.

Figure 5A:
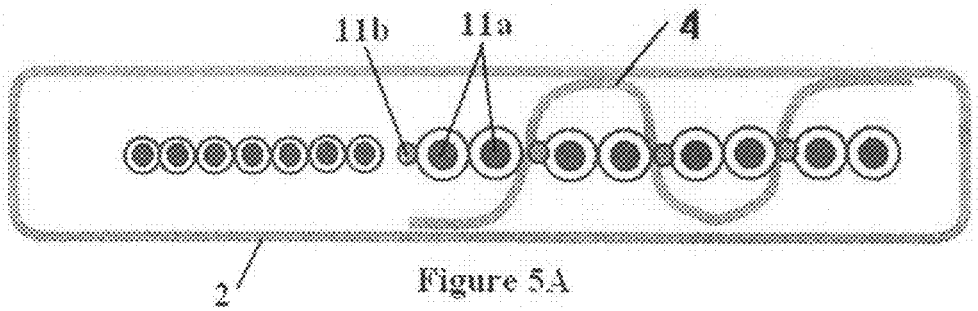
FIGS. 5A and 5B are sectional side views of the bus according to a second embodiment of the present invention.
Figure 5B:
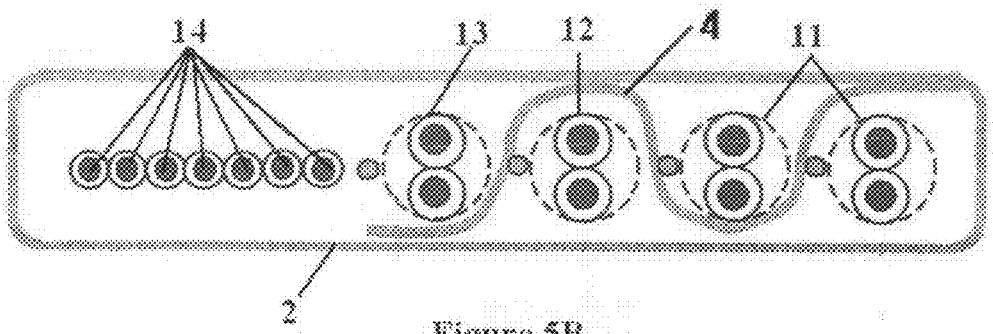

FIGS. 5A and 5B are sectional side views of the bus according to a second embodiment of the present invention. Referring to FIGS. 5A and 5B, each of the channel lines 11 comprises two stranded conductor lines 11*a* and a ground line 11*b*. A shield layer 4 is used to penetrates and separate channel lines 11 of the transmission lines 1 into a plurality groups of cord groups, each comprised of channel lines 11, to form a bus 10, or surround the channel lines of the transmission lines 1 to cover the shield layer to form a bus, in order to provide the shielding effect. Thus, the signal is protected from the external electromagnetic wave interference between the line groups during the high frequency signal transmission, and also a fine or a high quality audio/video frequency may be obtained.

In summary, the above-mentioned illustration merely describes the preferred embodiments of the present invention, not for restricting the range of the substantial technical contents, wherein the substantial technical contents of the present invention are generally defined in the following claims, and any technical items accomplished by others will all be considered as encompassed by the range of the present application, in which completely conforming with those defined in the following claims or equivalent changes of the same.

Description of Component Symbols in Drawings

1 Transmission Line
2 Cover Layer
10 Bus
11 Channel Lines
11*a* Conductor Lines
11*b* Ground Line
12 Clock Channel Line Set
13 Display Data Channel Line Set
14 Control Line
30 Transmission Line
32 Aluminum Foil Layer
33 Copper Braid Layer
34 Insulation Rubber Layer
311, 312 Conductor Line
311*a*, 312*a* Copper Conductor Line
311*b*, 312*b* Insulation Layer
4 shield layer Description of Major Component Symbols Assigned Major Diagram: FIG. 2
1 Transmission Line
2 Clad Layer
10 Bus

What is claimed is:

1. A bus for a high definition multimedia interface (HDMI) comprising:

a plural sets of transmission lines, wherein each set of transmission line comprises at least three sets of channel lines and each set of channel line comprises two mutually twisted conductor lines juxtaposed in a flat shape and a ground line;

a flat shield layer comprised of covering material separating the sets of channel lines from each other; and two clad layers, disposed on an upper surface and a lower surface of the transmission line sets and sandwiching the transmission line sets, wherein the clad layers comprise insulating plastic films.

2. The bus for a HDMI according to claim 1, wherein the transmission line sets comprise a clock channel line set, a display data channel line set, and a plurality of control lines.

3. The bus for a HDMI according to claim 1, wherein the clad layers are transparent.

4. The bus for a HDMI as claim 1, wherein the clad layers are opaque.

* * * * *